US007020431B2

(12) United States Patent
Sahara

(10) Patent No.: US 7,020,431 B2
(45) Date of Patent: Mar. 28, 2006

(54) IMAGE FORMING APPARATUS WITH DIFFERENT TRANSPORT SPEEDS IN TRANSFER UNIT AND FIXING UNIT

(75) Inventor: Hiroshi Sahara, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 131 days.

(21) Appl. No.: 10/690,650

(22) Filed: Oct. 23, 2003

(65) Prior Publication Data

US 2004/0131399 A1 Jul. 8, 2004

(30) Foreign Application Priority Data

Oct. 24, 2002 (JP) ..... 2002-309688

(51) Int. Cl.
*G03G 15/00* (2006.01)

(52) U.S. Cl. ..... 399/400; 399/397

(58) Field of Classification Search ..... 399/397, 399/400, 322

See application file for complete search history.

(56) References Cited

U.S. PATENT DOCUMENTS 4,769,670 A * 9/1988 Nishise ..... 399/397
4,876,576 A * 10/1989 Itaya et al. ..... 399/322
4,914,484 A * 4/1990 Kida ..... 399/322
5,285,245 A * 2/1994 Goto et al. ..... 399/322
5,771,434 A * 6/1998 Hokari ..... 399/400
6,108,514 A * 8/2000 Nakayama et al. ..... 399/400
6,324,358 B1 11/2001 Sahara ..... 399/66

FOREIGN PATENT DOCUMENTS

JP 2002068522 A * 3/2002

* cited by examiner

*Primary Examiner*—Susan Lee
(74) *Attorney, Agent, or Firm*—Fitzpatrick, Cella, Harper & Scinto

(57) ABSTRACT

An image forming apparatus has an image bearing unit for bearing a toner image, a transfer device for transferring the toner image on the image bearing unit onto a sheet, fixing unit for fixing to the sheet toner image, and first and second sheet transport guides disposed along a transport path. A sheet transport speed in the fixing unit is set lower than a sheet transport speed in the transfer device. The first and second sheet transport guides are each disposed with a tilt with respect to a horizontal or vertical direction. A gap is provided to form a spacing sufficient to permit curves of the sheet to be formed between a downstream-side end portion of the first sheet transport guide and an upstream-side end portion of the second sheet transport guide.

13 Claims, 7 Drawing Sheets

IMAGE FORMING APPARATUS WITH DIFFERENT TRANSPORT SPEEDS IN TRANSFER UNIT AND FIXING UNIT

BACKGROUND OF THE INVENTION

1. Field of the Invention

The present invention relates generally to image forming apparatuses such as copying machines, printers and facsimile machines that form images by using, for example, an electrophotographic scheme and an electrostatic recording scheme. More specifically, the invention relates to an intermediate-transfer-type image forming apparatus.

2. Description of the Related Art

In recent years, in the field of electrophotographic multicolor or full-color image forming apparatuses, so-called "in-line image forming apparatuses" are brought into practical use. The in-line image forming apparatuses have a plurality of photosensitive drums aligned in one line in units of a color, in which individual color toner images formed onto the individual photosensitive drums are sequentially superposed on an intermediate transfer member to form a color image.

FIG. 6 depicts an example of a conventional in-line electrophotographic full-color image forming apparatus (full-color copying machine) having an intermediate transfer member of the type described above. The image forming apparatus is configured of a printer section Pr and a reader section Sc. In this apparatus, image information of an original document sheet is obtained in the reader section Sc, and the image information is imaged over a transfer medium, such as paper, in the printer section Pr.

Image forming processes of the image forming apparatus will be outlined hereinbelow. When the image information is acquired from the original document sheet in the reader section Sc, as described above, light exposure corresponding to th image information is performed by an exposure apparatus 101. Then, electrostatic latent images are formed on photosensitive drums 103 disposed in an image forming section 102. The individual drums 103 are assigned for handling yellow, magenta, cyan, and black toner images. Toners are then supplied onto the latent images in the image forming section 102, and toner images are then formed. The toner images are primary-transferred onto an intermediate transfer belt 104, and are then secondary-transferred onto a transfer medium P in a secondary transfer section Te in a nip section defined between a secondary-transfer opponent roller 105 and a secondary transfer roller 106. Finally, the secondary-transferred toner images are fixed to the transfer medium P with pressure and heat in fixing means 107, and a permanent image is formed on the transfer medium P.

In the intermediate-transfer-type image forming apparatus as described above (refer to Japanese Patent Application Laid-Open No. 2001-066948, for example), since, in particular, the endless-belt-type intermediate transfer belt 104 is used as the intermediate transfer member, a degree of freedom takes place for disposing members such as a transfer-medium transport section 108, the secondary transfer section Te, and the fixing means 107. Reportedly, this enables shortening a transfer-medium transport path for the distance from the transfer-medium transport section 108 to the fixing means 107 via the secondary transfer section Te, therefore providing an advantage in miniaturization of the apparatus.

However, it has been pointed out that shortening the transfer-medium transport path creates the problem of causing mutual interference between a transfer process in the secondary transfer section Te and a fixing process in the fixing means 107.

In more detail, in the event that toner images are transferred to the transfer medium in the secondary transfer section Te and are fixed to the transfer medium P in the fixing means 107, a high quality image cannot be obtained unless the transfer medium P is transported at the speed controlled to be as constant as possible. However, since members, such as the secondary transfer section Te and the fixing means 107, are disposed close to each other, the fixing process in the fixing means 107 is undesirably commenced before completion of the transfer process in the secondary transfer section Te. At this event, suppose a case occurs in which, for example, the transfer-medium transport speed in the secondary transfer section Te is lower than the transfer-medium transport speed in the fixing means 107. In this case, the transfer medium P nipped in the secondary transfer section Te during the transfer process is forcedly pulled by the fixing means 107, thereby likely leading to an image defect.

Generally, to prevent the problem, the apparatus is designed such that a speed difference is provided between the transfer-medium transport speed in the secondary transfer section Te and the transfer-medium transport speed in the fixing means 107 (specifically, the transfer-medium transport speed in the fixing means 107 is set relatively lower). This causes the transfer medium P to form curves between the secondary transfer section Te and the fixing means 107 so that the curves sever as buffers to prevent the processes of the secondary transfer section Te and the fixing means 107 from being interfered with each other.

The transfer-medium transport speeds in the secondary transfer section Te and the fixing means 107 are influenced by factors, such as the type of the transfer medium, the density of the formed image, the operation environment, and the component durability. As such, it is very difficult to accurately control the speeds. For this reason, the speed difference between the transfer-medium transport speeds in the secondary transfer section Te and the fixing means 107 should be set with sufficient margins by taking all applicable conditions into account.

Under these circumstances, as shown in FIG. 7, depending on the condition, the curve between the secondary transfer section Te and the fixing means 107 can be grown larger. In this state, the image on the transfer medium P between the secondary transfer section Te and the fixing means 107 is unfixed. As such, when the curve is grown larger to an extent of bringing the transfer medium into contact with an interior portion of the apparatus main body, an image defect may occur, possibly entailing contamination of the apparatus interior. In addition, to prevent such contact with an interior portion of the apparatus, a sufficiently large spacing should be provided, thereby making it disadvantageous for miniaturization of the apparatus.

Further, as the curve is grown larger, the degree of freedom of the transfer medium P between the secondary transfer section Te and the fixing means 107 is increased. As such, wobbling, waviness, and/or the like of the transfer medium P can influence the secondary transfer section Te, the fixing means 107, and the like, thereby leading to the problem of causing, for example, an image defect and/or wrinkle of the transfer medium P.

SUMMARY OF THE INVENTION

To overcome the problems described above, an object of the present invention is to improve transfer-medium transport performance to obtain high quality images without requiring the apparatus to be enlarged.

In order to achieve the object described above, according to one aspect f the invention, an image forming apparatus comprises image bearing means for bearing a toner image; transfer means for transferring the toner image on the image bearing mean onto a sheet; fixing means for fixing to the sheet the toner image transferred by the transfer means; and sheet transport guide means for transporting a sheet placed along a sheet transport path between the transfer means and the fixing means, wherein a sheet transport speed in the fixing means is set lower than a sheet transport speed in the transfer means, and the sheet transport guide means is capable of forming a plurality of curves on the sheet between the transfer means and the fixing means.

According to another aspect of the invention, an image forming apparatus comprises image bearing means for bearing a toner image; transfer means for transferring the toner image on the image bearing means onto a sheet; fixing means for fixing to the sheet the toner image transferred by the transfer means; and a first sheet transport guide and a second sheet transport guide disposed from an upstream side of a transport direction of the sheet along a transport path of the sheet between the transfer means and the fixing means, wherein a sheet transport speed in the fixing means is set lower than a sheet transport speed in the transfer means, the first sheet transport guide is disposed with a tilt with respect to a horizontal direction or a vertical direction; the second sheet transport guide is disposed with a tilt with respect to the horizontal direction or the vertical direction; and a gap is provided to form a spacing sufficient to permit curves of the sheet to be formed between a downstream-side end portion of the first sheet transport guide and an upstream-side end portion of the second sheet transport guide.

According to still another aspect of the invention, an image forming apparatus comprises transfer means for transferring a toner image onto a sheet; fixing means for fixing to the sheet the toner image transferred by the transfer means; and a first sheet transport guide and a second sheet transport guide disposed from an upstream side of a transport direction of the sheet along a transport path of the sheet between the transfer means and the fixing means, wherein a sheet transport speed in the fixing means is set lower than a sheet transport speed in the transfer means, both an output direction of the sheet to be output from the transfer means and a tilt direction in a sheet transport direction of the first sheet transport guide are set downwardly from a horizontal direction, both an entering direction of the sheet into the fixing means and a tilt direction in a sheet transport direction of the second sheet transport guide are set upwardly from the horizontal direction, and a rear-end portion of the first sheet transport guide is positioned in substantially the center between the transfer means and the fixing means and is positioned upwardly from a front-end portion of the second sheet transport guide, whereby a spacing sufficient to permit curves of the sheet to be armed is formed.

As described above, the invention provides the configuration in which, while the transfer medium is being forwarded from the transfer means to the fixing means along the first and second sheet transport guides, the sheet is bent to form small "S"-shaped curves. Thereby, the invention improves the transport performance for transfer media, consequently enabling high quality images to be secured without requiring the apparatus to be enlarged.

DESCRIPTION OF THE PREFERRED EMBODIMENTS

The present invention will be described hereinbelow with reference to embodiments shown in the accompanying drawings.

(First Embodiment)

Figure 2:
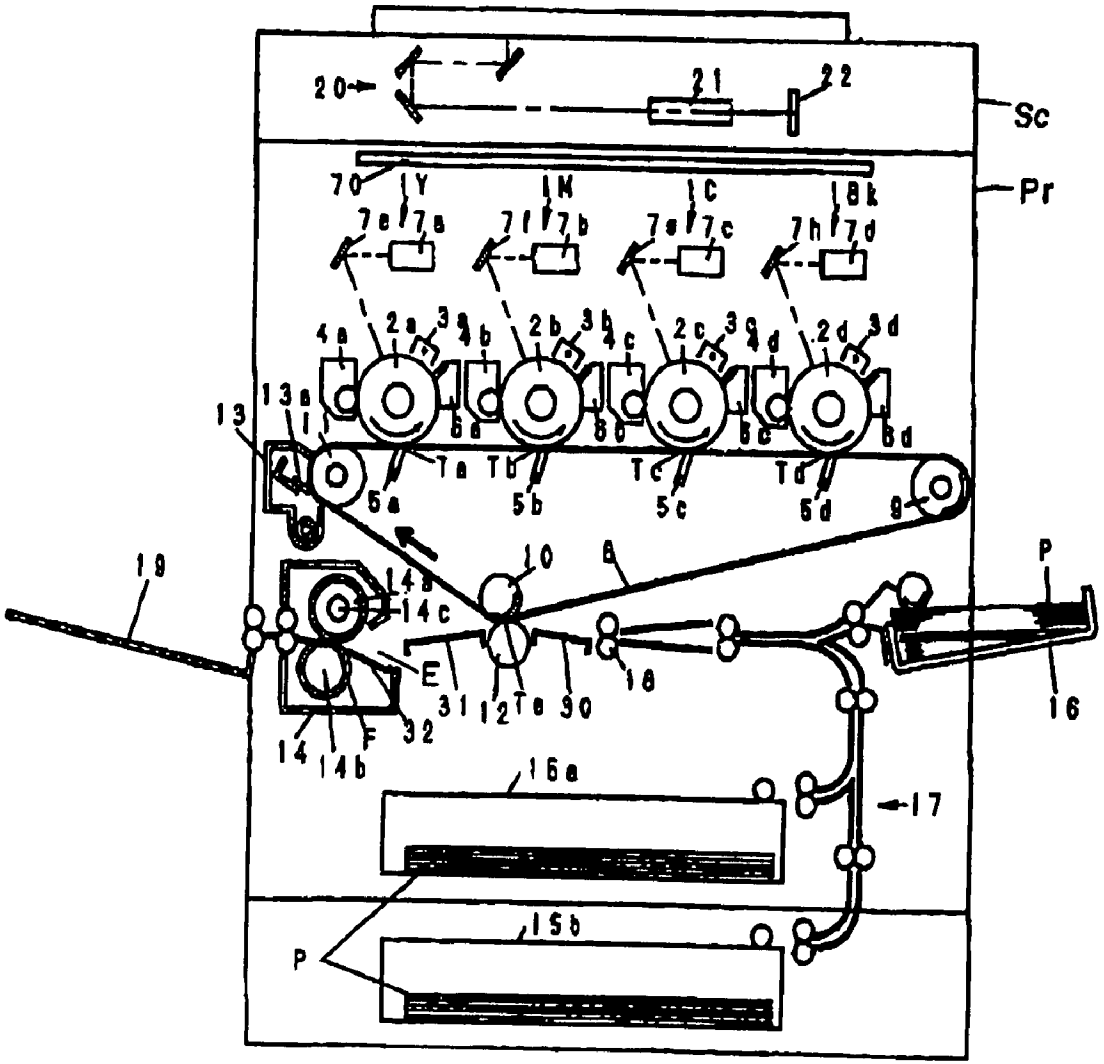
FIG. 2 is a schematic configuration view of the image forming apparatus according to the first embodiment.

FIG. 2 is a schematic configuration view of an image forming apparatus (electrophotographic in-line full-color copying machine) according to a first embodiment of the invention.

(Image Forming Apparatus)

The image forming apparatus of the first embodiment has a configuration including a printer section Pr and a reader section Sc. The printer section Pr has four image forming sections (image forming units) 1Y, 1M, 1C, and 1Bk. The section 1Y forms yellow images, the section 1M forms magenta images, the section 1C forms cyan images, and section 1Bk forms black images. The four sections 1Y, 1M, 1C, and 1Bk are aligned along one line at predetermined intervals.

In the respective image forming sections 1Y, 1M, 1C, and 1Bk, there are mounted drum-type electrophotographic photosensitive units 2*a*, 2*b*, 2*c*, and 2*d* (each of which hereinbelow will be referred to as a photosensitive drum) that individually serve as image bearing members. Provided in peripheral portions of the respective photosensitive drums 2*a*, 2*b*, 2*c*, and 2*d* are chargers 3*a*, 3*b*, 3*c*, and 3*d*; developing units 4*a*, 4*b*, 4*c*, and 4*d*; transfer blades 5*a*, 5*b*, 5*c*, and 5*d*; and drum cleaning units 6*a*, 6*b*, 6*c*, and 6*d*. Exposure devices 7*a*, 7*b*, 7*c*, and 7*d* are mounted above portions between the respective chargers 3*a*, 3*b*, 3*c*, and 3*d* and the respective developing units 4*a*, 4*b*, 4*c*, and 4*d*. A yellow toner, a magenta toner, a cyan toner, and a black toner are stored in the developing units 4*a*, 4*b*, 4*c*, and 4*d*, respectively.

The individual photosensitive drums 2*a*, 2*b*, 2*c*, and 2*d* have photoconductive layers over aluminium drum bodies individually formed of negatively charged OPC photosensitive units, and are rotationally driving by a driver unit (not shown) at a predetermined process speed in the direction (counterclockwise) indicated by the arrow. Using a charging bias applied from a charging bias power source (not shown), the chargers 3*a*, 3*b*, 3*c*, and 3*d* serving as charger means uniformly charge the surfaces of the respective photosensitive drums 2*a*, 2*b*, 2*c*, and 2*d* to a predetermined negative polarity potential.

The developing units 4*a*, 4*b*, 4*c*, and 4*d* cause toners of the individual colors to be adhered to individual electrostatic latent images formed on the corresponding photosensitive drums 2*a*, 2*b*, 2*c*, and 2*d*. Thereby, the individual electrostatic latent images are thereby developed (rendered visible) to form toner images. In this embodiment, a two-component contact developing scheme may be employed as a developing method to be performed by the developing units 4*a*, 4*b*, 4*c*, and 4*d*. According to this scheme, a developer formed by mixing magnetic carriers into toner particles is used. The developer is transferred by using a magnetic force, and toner images are developed onto the individual photosensitive drums 2*a*, 2*b*, 2*c*, and 2*d* in a contact state.

The transfer blades 5*a*, 5*b*, 5*c*, and 5*d* serving as transfer means are individually formed of resilient members. These blades 5*a*, 5*b*, 5*c*, and 5*d* are disposed in contact with the photosensitive drums 2*a*, 2*b*, 2*c*, and 2*d*, respectively, at nip portions of primary transfer sections Ta, Tb, Tc, and Td via an endless-belt-type intermediate transfer member 8 (which hereinbelow will be referred to as an "intermediate transfer belt"). Although the transfer blades 5 (5*a*, 5*b*, 5*c*, and 5*d*) are thus used as the transfer means, the transfer blades 5 may be replaced with transfer rollers. In this case, in the event of transferring toner images to the transfer medium, the transfer rollers may be applied with high pressure to thereby be in contact with the intermediate transfer belt 8.

The intermediate transfer belt 8 is placed with tension on a track with a driver roller 9, a secondary-transfer opponent roller 10, and a tension roller 11. The belt 8 is rotated (moved) through operation of the driver roller 9 in the direction indicated by the arrow (clockwise direction). The belt 8 is formed of a dielectric resin, such as a polycarbonate film, polyethylene terephthalate resin film, or polyvinylidene fluoride resin film.

The secondary-transfer opposition roller 10 is disposed in contact with a secondary transfer roller 12 via the intermediate transfer belt 8, whereby a secondary transfer section Te is formed. The secondary transfer roller 12 is disposed disengageable or engageable with respect to the intermediate transfer belt 8. A belt cleaning device 13 is disposed near the tension roller 11 situated on an outer side of the belt 8. The cleaning device 13 is responsible to remove and collect transfer residual toner remaining on the intermediate transfer belt 8. In the cleaning device 13, a plate-like blade member 13*a* formed of a resilient material is disposed in contact with the intermediate transfer belt 8. In addition, fixing means 14 having a fixing roller 14*a* and a pressure roller 14*b* is disposed downstream of the direction of transport of the transfer medium by the secondary transfer section Te.

The drum cleaning devices 6*a*, 6*b*, 6*c*, and 6*d* are provided that remove transfer residual toner remaining on the surfaces of the respective photosensitive drums 2*a*, 2*b*, 2*c*, and 2*d* by using blade members for toner collection. The exposure devices 7*a*, 7*b*, 7*c*, and 7*d* operate as described hereunder. A laser output section (not shown) outputs laser light modulated corresponding to image-information time-series electric digital pixel signals individually input from the reader section Sc. In response to the signals, the surfaces of the individual photosensitive drums 2*a*, 2*b*, 2*c*, and 2*d* are exposed to the laser light via individual polygon mirrors (not shown) or else. Thereby, electrostatic latent images of the individual colors corresponding to the image information are formed over the surfaces of the individual drums 2*a*, 2*b*, 2*c*, and 2*d* that have been charged by the chargers 3*a*, 3*b*, 3*c*, and 3*d*.

The reader section Sc has a scanner section 20 that emits light to an original document sheet (not shown) for performing scanning. Scan light (light deflected off the original document sheet) from the scanner section 20 is input to a charge-coupled device 22 (CCD) via an optical lens system 21 and is converted thereby into an electric signal. Subsequently, the electric signal undergoes processing such as color separation, and the results are then input to the individual exposure devices 7*a*, 7*b*, 7*c*, and 7*d* of the printer section Pr.

(Image Forming Operation)

Image forming operations of the image forming apparatus will be described hereinbelow. Upon input of an image-formation commencement signal, the individual photosensitive drums 2*a*, 2*b*, 2*c*, and 2*d* of the image forming sections 1Y, 1M, 1C, and 1Bk that are rotationally driven at a predetermined process speed are uniformly charged to a negative polarity through the respective chargers 3*a*, 3*b*, 3*c*, and 3*d*. Then, processes are performed with the exposure devices 7*a*, 7*b*, 7*c*, and 7*d* as described hereunder. Color-separation image signals representing image information of an original document sheet (not shown), which have been input through the reader section Sc, are individually converted into optical signals. Then, the signals are used to perform scan and exposure of the surfaces of the photosensitive drums 2*a*, 2*b*, 2*c*, and 2*d* via respective reflecting mirrors 7*e*, 7*f*, 7*g*, and 7*h*. Thereby, electrostatic latent images are formed.

Subsequently, first, the developing unit 4*a* applied with a developing bias having the same polarity as the charge polarity (negative polarity) of the photosensitive drum 2*a* operates to cause the yellow toner to be adhered to the electrostatic latent image formed over the drum 2*a*. Then, a yellow toner image is formed by rendering the electrostatic latent image to be visible. In the primary transfer section Ta between the drum 2*a* and the transfer blade 5*a*, the yellow toner image is primary-transferred onto the rotating (moving) intermediate transfer belt 8 by using the blade 5*a* to which a primary-transfer bias (having the positive polarity opposite to the polarity of the toner) is applied. The intermediate transfer belt 8 having the yellow toner image transferred thereto is rotated (moved) toward the image forming section 1M. Then, processes similar to the above are performed in the image forming section 1M for a magenta toner image armed on the photosensitive drum 2*b*. That is, the magenta toner image is superimposed over the yellow toner image previously transferred to the intermediate transfer belt 8, and the superimposed toner images are then transferred in the primary transfer section Tb.

Subsequently, in similar manners, cyan and black toner images formed on the photosensitive drums 2*c* and 2*d* of the image forming sections 1C and 1Bk are sequentially superimposed, respectively, in the primary transfer sections Tc and Td on the yellow and magenta toner images that have been superimposed and transferred over the intermediate transfer belt 8. Thereby, a full color toner image is formed over the intermediate transfer belt 8.

An edge of the fill color toner image thus formed over the intermediate transfer belt 8 is transported to the secondary transfer section Te between the secondary-transfer opposition roller 10 and the secondary transfer roller 12. In line with the transport timing, a transfer medium P (paper) is selected from one of feeder cassettes 15*a* and 15*b* and a manual insertion cassette 16, and is fed via a transfer medium transport section 17. The transfer medium P is then transported by resist rollers 18 to the secondary transfer section Te. At this event, the secondary transfer roller 12 is brought into contact with the secondary-transfer opposition roller 10 via the intermediate transfer belt 8. Then, the individual color toner images are secondary-transferred in one time as a full color toner image to the transfer medium P by using the secondary transfer roller 12 to which a secondary-transfer bias (having the positive polarity opposite to the polarity of the toner) is applied.

The transfer medium P onto which the full color toner image has been formed is transported to the fixing means 14. Then, the full color toner image is heated and pressed by using a fixing nip disposed between the fixing roller 14*a* and the pressure roller 14*b*, and is thereby thermally fixed to form a full color image over the surface of the transfer medium P. Thereafter, the transfer medium P is output to an output tray 19. This completes a series of image forming processes.

In the configuration, a monochrome image can be obtained in the following manner. A specific image forming section (the image forming section 1Bk, for example) is used to primary-transfer a visible image to the intermediate transfer belt 8. Subsequently, processes similar to those for forming the full color image are performed, thereby enabling the monochrome image to be obtained.

In the primary transfer processes, primary-transfer residual toner remaining on the individual photosensitive drums 2*a*, 2*b*, 2*c*, and 2*d* is removed and collected by the respective drum cleaning devices 6*a*, 6*b*, 6*c*, and 6*d*. Secondary-transfer residual toner remaining on the intermediate transfer belt 8 after the secondary transfer processes is scraped off and collected by the blade member 13*a* of the belt cleaning device 13.

Additionally provided in the configuration are a pre-secondary-transfer guide 30, a first transfer medium transport guide 31, and a second transfer medium transport guide 32. The transfer guide 30 is disposed upstream of the direction of transport of the transfer medium P by the secondary transfer section Te to guide the transfer medium P to the secondary transfer section Te. The transport guides 31 and 32 are disposed downstream of the direction of transport of the transfer medium P by the secondary transfer section Te to guide the transfer medium P, onto which a toner image is transferred, to the fixing means 14.

The secondary transfer roller 12 is urged by a roller pressing spring (not shown) at an appropriate pressure (preferably at 5,880 to 39,200 mN) into contact with the secondary-transfer opposition roller 10 via the intermediate transfer belt 8. Thereby, the secondary transfer roller 12 is passively rotated with a frictional force caused between itself and the intermediate transfer belt 8. While the secondary transfer roller 12 is a resilient-material roller, such as an urethane rubber roller, having a diameter of 16 to 30 mm, the roller 12 may be a metal roller formed from an aluminum pipe, for example. Taking transport performance for the transfer medium P at the secondary transfer section Te into account, the configuration may be arranged such that the secondary transfer roller 12 is rotationally driven by a pulse motor or the like drive.

The first transfer medium transport guide 31 is provided downstream of the direction of transport of the transfer medium P by the secondary transfer section Te to guide the transfer medium P to the second transfer medium transport guide 32. The second transfer medium transport guide 32 is provided upstream of the direction of transport of the transfer medium P by the fixing means 14 to guide to a nip portion F of the fixing means 14.

The fixing means 14 is configured of the fixing roller 14*a*, which includes a heat source such as a halogen heater 14*c*, and the pressure roller 14*b* that is pressed by the fixing roller 14*a* (there can be a case that also the pressure roller 14*b* has a heat source).

(Feature Portions for the First Embodiment)

Figure 1:
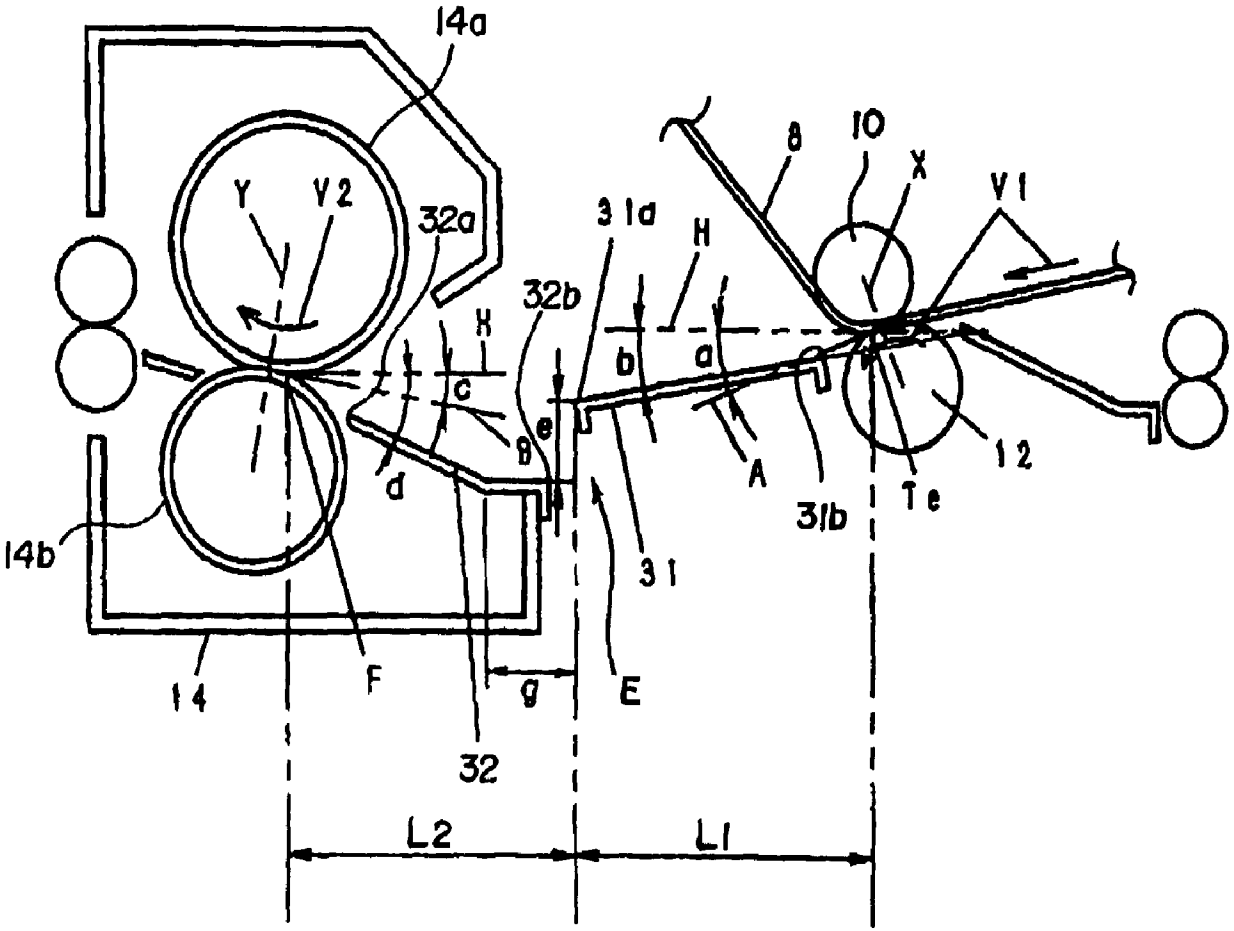
FIG. 1 is a schematic configuration view of a transfer-medium transport path from a secondary transfer section to fixing means of an image forming apparatus according to a first embodiment of the invention.

With reference to FIG. 1, feature portions of the first embodiment will be described hereinbelow. FIG. 1 is a schematic configuration view of a transfer-medium transport path from the secondary transfer section Te to the fixing means 14.

A transfer medium P is output from the secondary transfer section Te in a direction of a nip-portion tangent line A (perpendicular line extending from the transfer nip portion with respect to a center line X connecting the center of the secondary transfer roller 12 and the center of the secondary-transfer opposition roller 10). The tangent line A is set downward by an angle a with respect to a horizontal line H in the transfer-medium transport direction. A guide surface of the first transfer medium transport guide 31 is set downward by an angle b to the transport direction with respect to the horizontal line H in the transfer-medium transport direction. The relationship between the angles a and b is set to satisfy a>b.

A front-end portion 31*b* (upstream-side end portion in the sheet transfer direction) of the first transfer medium transport guide 31 is disposed close to the nip between the secondary-transfer opposition roller 10 and the secondary transfer roller 12. A rear-end portion 31*a* (downstream-side end portion in the sheet transfer direction) of the transport guide 31 is disposed in substantially the center of the transfer-medium transport path from the secondary transfer section Te to the fixing nip portion F ($L_1 \approx L_2$ in FIG. 1). A gap E having a distance e is provided between the rear-end portion 31*a* of the first transfer medium transport guide 31 and a front-end portion 32*b* (downstream side in the sheet transfer direction) of the second transfer medium transport guide 32. The distance e of the gap E is appropriately set in accordance with the length of the transfer medium P to be transferred, the transfer-medium transport speed in the transfer section Te, and the transfer-medium transport speed in the fixing means 14. However, the distance e is preferably set to about 5 mm to 20 mm. With the gap E being thus provided, a spacing D (shown in FIGS. 3C and 3D) is formed to permit curves of the sheet (transfer medium P), as will be described below. The guide surface of the second transfer medium transport guide 32 is formed to be substantially horizontal in a portion of a distance g from the rear-end portion 31*a* of the transport guide 31 and to be upwardly tilted at an angle d in the transport direction from the horizontal portion. In addition, a rear-end portion 32*a* (downstream-side end portion in the transport direction) of the second transfer medium transport guide 32 is provided close to a nip portion between the fixing roller 14*a* and the pressure roller 14*b* to guide the transfer medium P to the fixing nip portion F. The transfer medium P transported from the transport guide 32 enters from the direction of nip-portion tangent line B (perpendicular line extending from the fixing nip portion F with respect to a center line Y connecting the center of the fixing roller 14*a* and the center of the pressure roller 14*b*). The nip-portion tangential line B extends upwardly along the transport direction by an angle c from the horizontal line H in the transfer-medium transport direction.

In the secondary transfer section Te, the secondary transfer roller 12 and the intermediate transfer belt 8 are rotated at a speed V1 to transport the transfer medium P at the speed V1. The fixing roller 14*a* and the pressure roller 14*b* in the fixing means 14 are rotated at a rotation speed V2 to transport the transfer medium P at the speed V2. The speeds V1 and V2 are set in all times to satisfy V1>V2.

Figure 3:
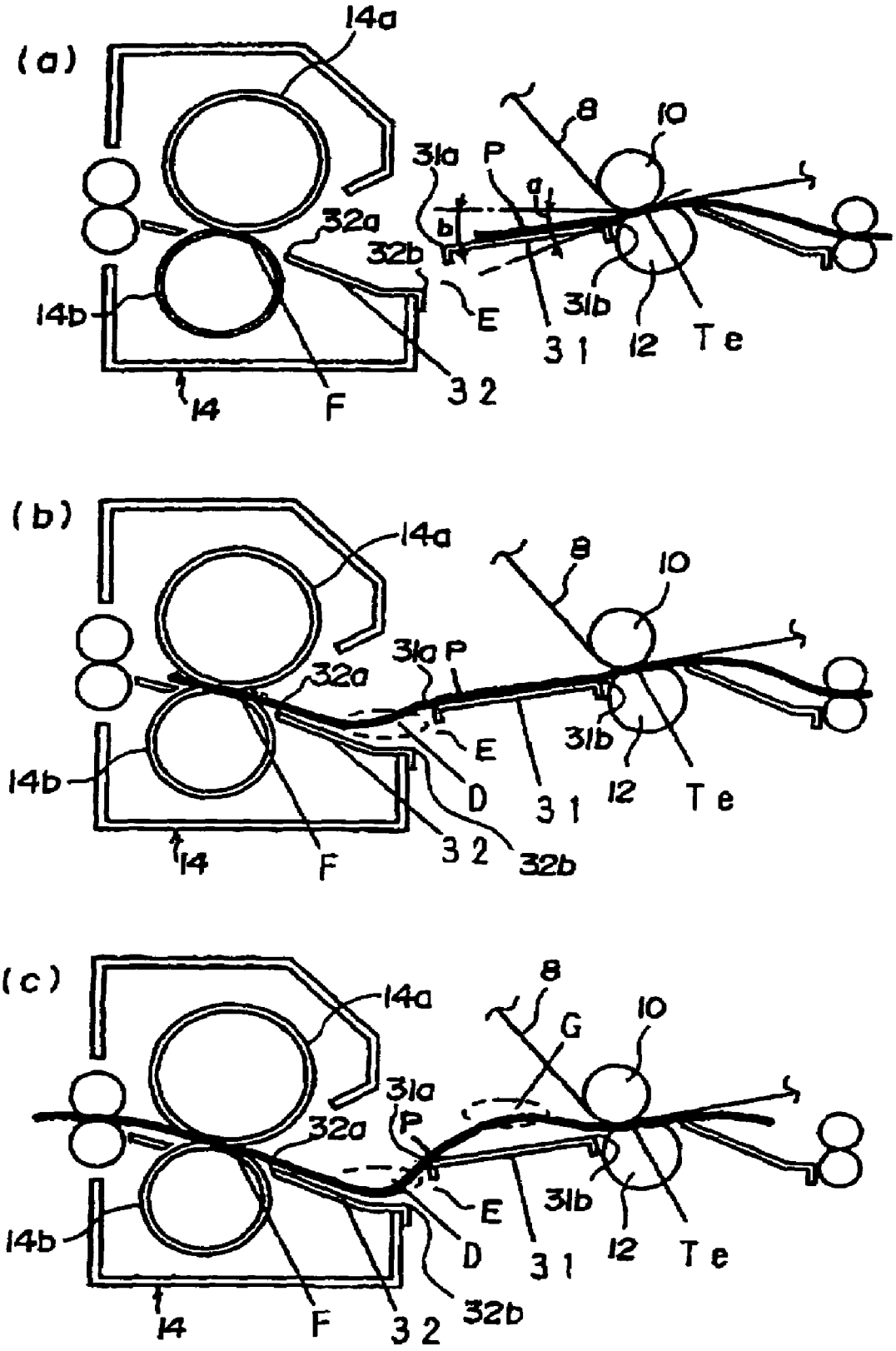
FIGS. 3A to 3C are views showing transfer-medium transport operations of the image forming apparatus according to the first embodiment.

Transfer-m dium transport operations for the transfer medium P in the above-described configuration will be described hereinbelow with reference to FIGS. 3A to 3C. Referring first to FIG. 3A, the transfer medium P output from the secondary transfer section Te is transported to the fixing means 14 along the first transfer medium transport guide 81. In this event, since the angle b is smaller than the angle "a" of the output direction (nip-portion tangent line A) of the transfer medium P from the secondary transfer section Te, the transfer medium P is pressed by the first transfer medium transport guide 31. Consequently, the transfer medium P is always transported along the first transfer medium transport guide 31 without exception.

Referring then to FIG. 3B, the transfer medium P is guided to the fixing nip portion F. In this event, since the rotation speed V2 of the fixing roller 14*a* is lower than the speed V1, at which the transfer medium P has been transported by the secondary transfer roller 12 and the like rollers, the transfer medium P is bent to form a downwardly protruding curve (downward curve) in the initial spacing D. With reference to FIG. 3C, as the downward curve is grown larger in the spacing D, the transfer medium P is bent from a start portion in the rear-end portion 31*a* of the first transfer medium transport guide 31 to form an upwardly protruding curve (upward curve) in a spacing G above the first transfer medium transport guide 31. As such, when the transfer medium P is held by both the secondary transfer section Te and the fixing nip portion F, while the downward curve in the spacing D and the upward curve in the spacing G are being synchronously formed (the curves hereinbelow will be referred to as "S"-shaped curves), the transfer medium P is concurrently transported.

As described above, according to the first embodiment, the image forming apparatus is configured such that factors such as the transport speed of th secondary transfer roller 12 and the transport speed of the fixing means 14 are preset. In addition, factors such as the angles of the first transfer medium transport guide 31 and the second transfer medium transport guide 32 are preset to permit the transfer medium P to form small "S"-shaped curves. With this configuration, since the individual curves formed on the transfer medium P can be small, large curve spacings need not be formed in the main body of the apparatus. This significantly contributes to miniaturization of the apparatus. In addition, since the individual curves are small, a transfer medium P bearing an unfixed image can be prevented from being brought into contact with an interior portion of the apparatus main body. As such, the apparatus main body interior is not contaminated by the contact, thereby enabling a defective image from being created because of the contact of the unfixed image surface. Further, since the individual curves are small, the degree of freedom of the transfer medium P is low. This consequently enables an abnormal image to be prevented from being created because of wobbling, waviness, and/or the like of the transfer medium P.

(Second Embodiment)

Figure 4:
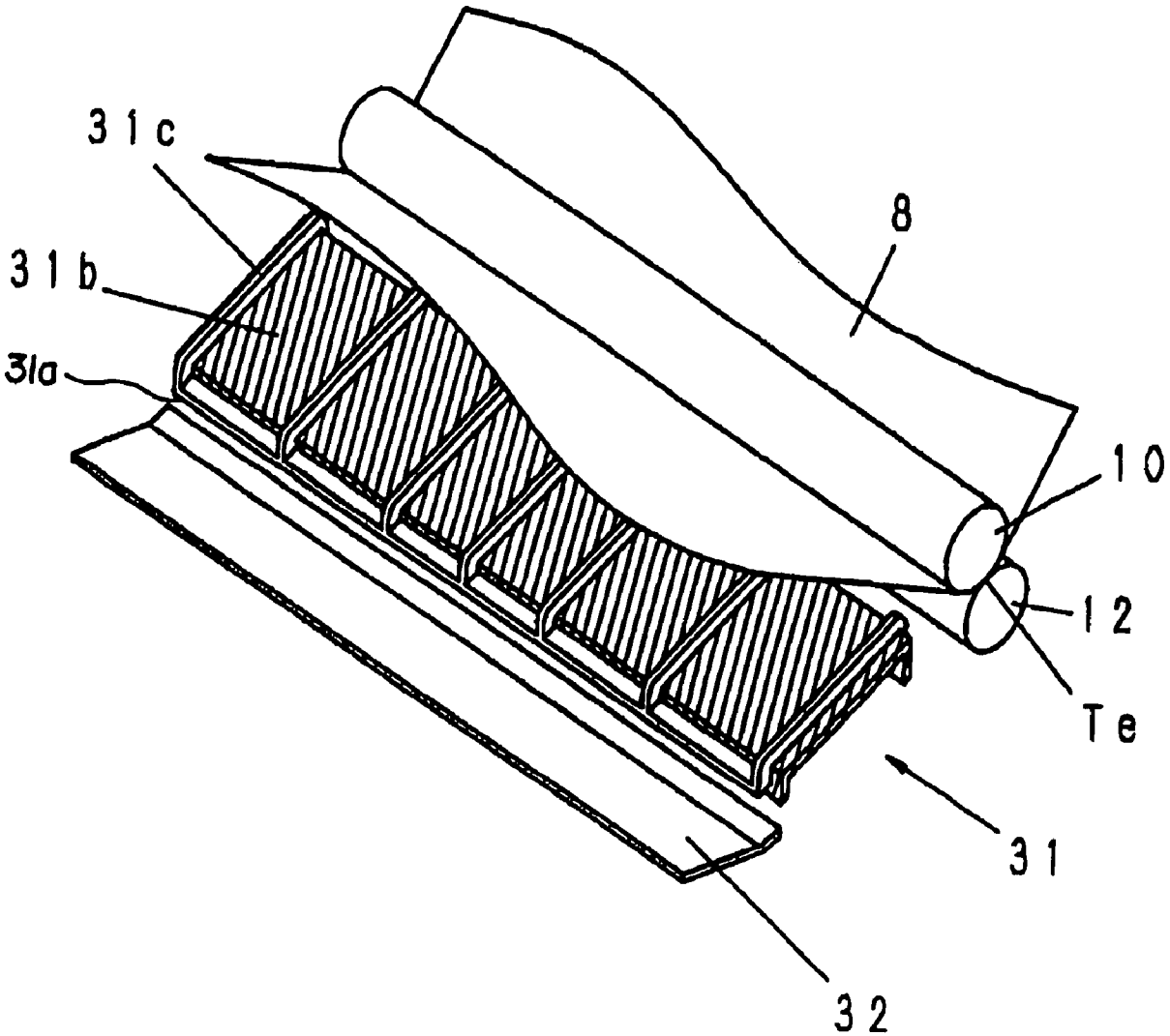
FIG. 4 is a perspective view of a transfer-medium transport path from a secondary transfer section to fixing means of an image forming apparatus according to a second embodiment of the invention.

With reference to FIG. 4, feature portions according to a second embodiment of the invention will be described hereinbelow. FIG. 4 is a perspective view of a secondary transfer section Te, a first transfer medium transport guide 31, and a second transfer medium transport guide 32 according the second embodiment. The second embodiment has a configuration similar to the first embodiment in that "S"-shaped curves are armed from the start portion in a rear-end portion 31*a* of the first transfer medium transport guide 31. However, the second embodiment is capable of further stabilizing the behavior of the transfer medium P in a path along which the front end of the transfer medium P is transported to the fixing means.

In more detail the first transfer medium transport guide 31 is configured of guide ribs 31*c*, which are formed of a resin material to have a ladder-like shape, and a grounded metal guide plate 31*b* (hatched portion), in which a grounded metal surface is exposed in regions of the transport surface other than the guide ribs 31*c*. According to the configuration, the transfer medium P having passed through the secondary transfer section Te is electrically attracted to the guide plate 31*b*. As such, even in an event that the front end of the transfer medium P having passed through the secondary transfer section Te is curled, the transfer medium P is electrically adsorbed to the guide plate 31*b*. Therefore, the transfer medium P can stably be transported along the guide ribs 31*c*, and subsequent formation of "S"-shaped curves can smoothly be implemented.

(Third Embodiment)

Figure 5:
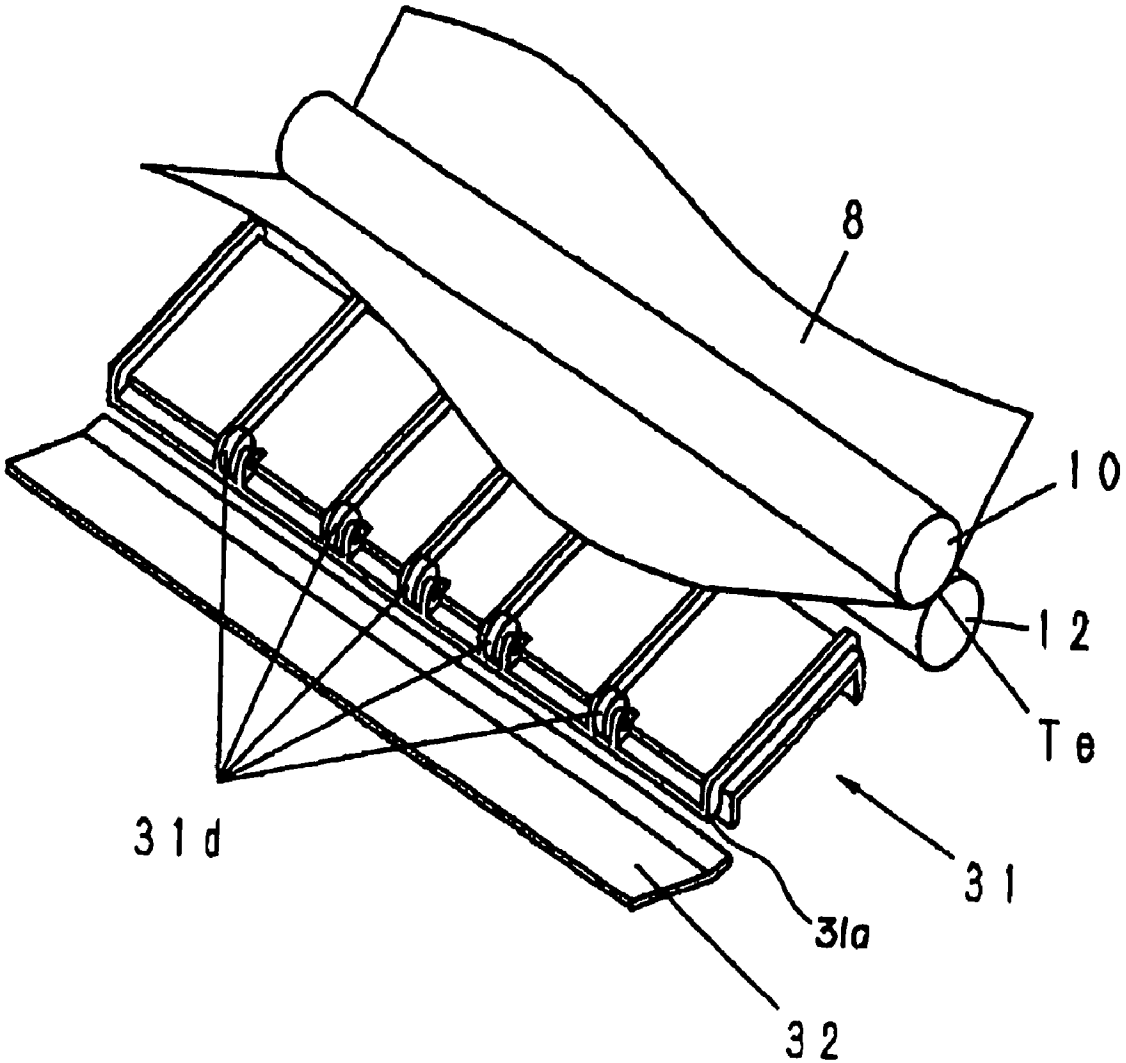
FIG. 5 is a perspective view of a transfer-medium transport path from a secondary transfer section to fixing means of an image forming apparatus according to a third embodiment of the invention.
Figure 6:
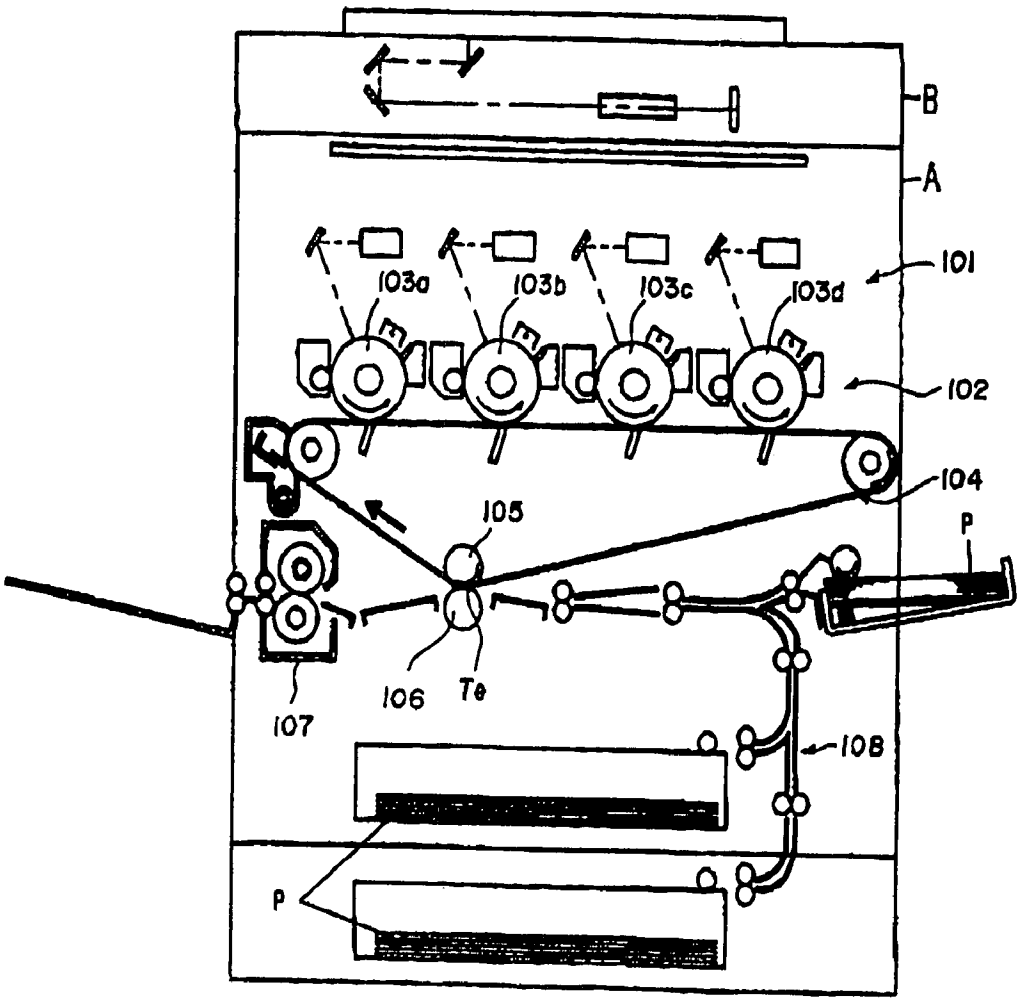
FIG.6 PRIOR ART
FIG. 6 is a view showing an example of a conventional electrophotographic full color image forming apparatus having an in-line intermediate transfer member.
Figure 7:
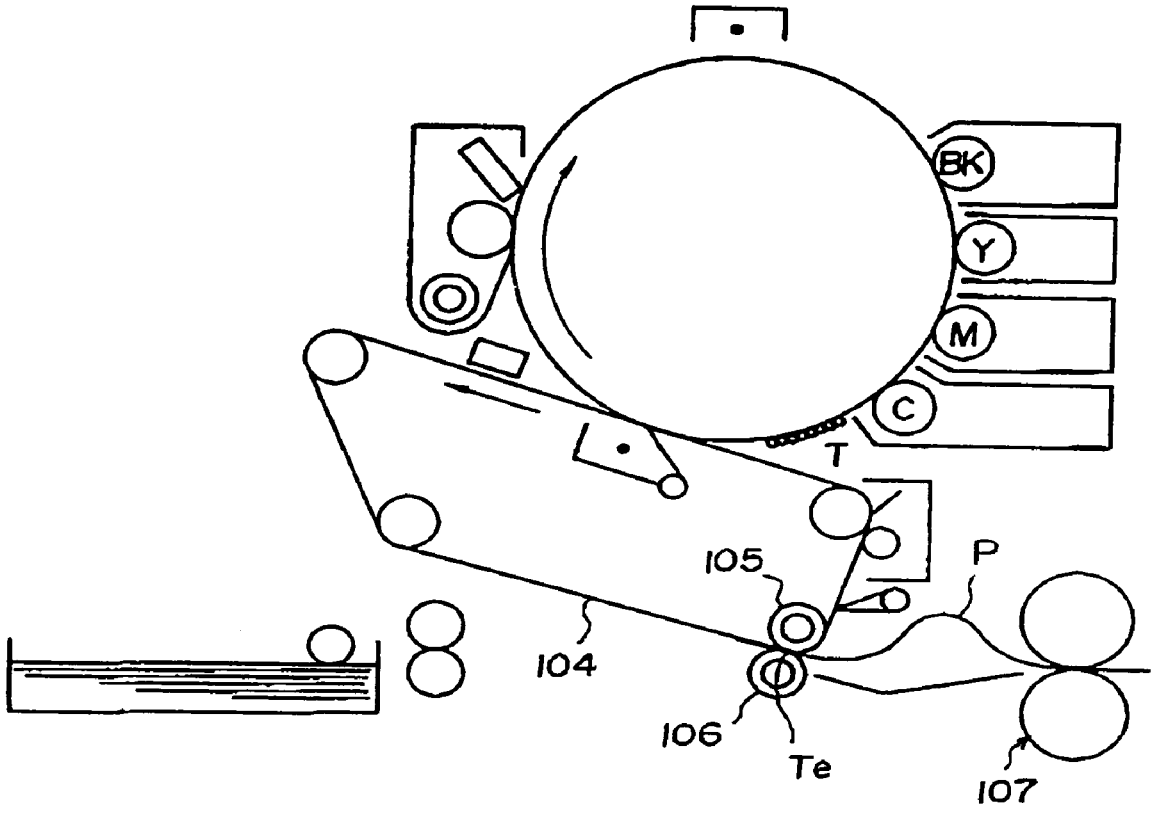
FIG.7 PRIOR ART
FIG. 7 is an explanatory view showing a case where a curve is enlarged between a secondary transfer section and fixing means of the conventional image forming apparatus.

With reference to FIG. 5, feature portions according to a third embodiment of the invention will be described hereinbelow. FIG. 5 is a perspective view of a secondary transfer section Te, a first transfer medium transport guide 31, and a second transfer medium transport guide 32 according to the third embodiment. The third embodiment has a configuration similar to the first embodiment in that "S"-shaped curves are formed from the start portion in a rear-end portion 31*a* of the first transfer medium transport guide 31. However, among other things, the second embodiment has features for solving problems occurable in forming the curves.

In more detail, when, as shown in FIG. 3C, the "S"-shaped curves have been formed from the start portion in the rear-end portion 31*a* of the first transfer medium transport guide 31, since the transfer medium P having the curves is supported only by the rear-end portion 31*a* of the first transfer medium transport guide 31, local forces are exerted thereon. As such, sliding friction between the end portion 31*a* of the first transfer medium transport guide 31 causes loads to be imposed during transport, thereby unstabilizing the transport performance. In addition, triboelectrical charging is occurred by the sliding friction between the rear-end portion 31*a* of the first transfer medium transport guide 31 and the transfer medium P. The triboelectrical charging can cause an unfixed image to fluctuate, possibly leading to an image defect.

To overcome these problems, as shown in FIG. 5, the configuration is provided with a plurality of driven rollers 31*d* that are each formed of a resin material and are disposed in the width direction of the transfer medium P in a rear-end portion of the first transfer medium transport guide 31. According to this configuration, even in the event of forming "S"-shaped curves on the transfer medium P, the transfer medium P is transported in contact with the driven rollers

31*d*, therefore preventing sliding friction from occurring between the rear-end portion 31*a* of the first transfer medium transport guide 31 and the transfer medium P. Thereby, the transfer medium P can be smoothly bent to form curves, consequently enabling an image defect from being caused by triboelectrical charging.

(Other Embodiments)

As above, the embodiments have each been discussed with reference to exemplifying the copying machine by way of the image forming apparatus of the invention. However, the image forming apparatus is not limited to a copying machine, and it may be any one of other apparatuses such as printers and facsimile machines.

Further, although the invention is well suited for image forming apparatuses using an intermediate transfer member with a spacing being preserved between transfer means and fixing means, such the intermediate transfer member is not necessarily required. For example, the invention may be adapted to image forming apparatuses of the type having a configuration in which a plurality of image bearing members individually bearing toner images are disposed opposite to a plurality of transfer means that transfer the toner images on the respective image bearing members onto a transfer medium via a transfer medium transport belt. In this configuration, images are formed while the transfer medium is being transferred between the image bearing members and the transfer means.

In the above case, factors such as the angle between the fixing means and closest one of the transfer means and the relationship between a first transfer medium transport guide 31 and a second transfer medium transport guide 32 may be set as those in the embodiments described above. Thereby, the configuration enables obtaining effects similar to those of the embodiments described above.

Further, each of the embodiments described above has disclosed the example cases in which the present invention is applied to the image forming apparatuses that transport the sheet in substantially the horizontal direction to perform transfer and fixing operations. However, the invention may be applied to other image forming apparatuses of the type that performs transfer and fixing in the course of transporting the sheet from a lower portion to an upper portion. In this case, with reference to FIG. 1, the configuration may be arranged such that the direction is set to a vertical direction V in place of the horizontal direction H, whereby the transfer means is set in the lower side, and the fixing means is set in the upper side. Thus, while only the direction needs to be changed from the horizontal direction to the vertical direction, the basic configuration need not be modified.

What is claimed is:

1. An image forming apparatus comprising:

image bearing means for bearing a toner image;

transfer means for transferring the toner image on the image bearing means onto a sheet;

fixing means for fixing to the sheet the toner image transferred by the transfer means; and sheet transport guide means for transporting a sheet placed along a sheet transport path between the transfer means and the fixing means, wherein a sheet transport speed in the fixing means is set lower than a sheet transport speed in the transfer means; and wherein the sheet transport guide means is capable of forming a plurality of curves on the sheet between the transfer means and the fixing means in such a manner that:

in a downstream side of the transfer means, an upward curve protruding upwardly from a tangential line to a nip portion of the transfer means is formed; and in an upstream side of the fixing means, a downward curve downwardly protruding from the tangential line to the nip portion of the fixing means is formed, wherein the transfer means comprises:

an intermediate transfer member onto which the toner image on the image bearing means is primary-transferred; and secondary transfer means for secondary-transferring the toner image on the intermediate transfer member onto the sheet, the secondary transfer means being a transfer roller that is applied with a high pressure and is in contact with the intermediate transfer member when transferring the toner image to the sheet.

2. An image forming apparatus comprising:

image bearing means for bearing a toner image;

transfer means for transferring the toner image on the image bearing means onto a sheet;

fixing means for fixing to the sheet the toner image transferred by the transfer means; and a first sheet transport guide and a second sheet transport guide sequentially arranged from an upstream side of a transport direction of the sheet along a transport path of the sheet between the transfer means and the fixing means, wherein a sheet transport speed in the fixing means is set lower than a sheet transport speed in the transfer means, the first sheet transport guide is disposed with a tilt with respect to a horizontal direction or a vertical direction and a downstream-side end portion of the first sheet transport guide is positioned in substantially the center between the transfer means and the fixing means, the second sheet transport guide is disposed with a tilt with respect to the horizontal direction or the vertical direction, and a gap is provided to form a spacing sufficient to permit curves of the sheet to be formed between a downstream-side end portion of the first sheet transport guide and an upstream-side end portion of the second sheet transport guide.

3. The image forming apparatus according to claim 2, wherein a guide surface of the second sheet transport guide comprises: a flat face extending in the horizontal direction or the vertical direction in the upstream-side end portion; and a sloped face continuing from the flat face.

4. The image forming apparatus according to claim 2, wherein a tilt angle in the sheet transport direction of the first sheet transport guide is set smaller than an angle of outputting the sheet that is output from the transfer means.

5. The image forming apparatus according to claim 2, wherein the gap between the first sheet transport guide and the second sheet transport guide is ranged from 5 mm to 20 mm.

6. The image forming apparatus according to claim 2, wherein the transfer means comprises:

an intermediate transfer member onto which the toner image on the image bearing means is primary-transferred; and secondary transfer means for secondary-transferring the toner image on the intermediate transfer member onto the sheet, the secondary transfer means being a transfer roller that is applied with a high pressure and is in contact with the intermediate transfer member when transferring the toner image to the sheet.

7. An image forming apparatus comprising:

transfer means for transferring a toner image onto a sheet;

fixing means for fixing to the sheet the toner image transferred by the transfer means; and a first sheet transport guide and a second sheet transport guide sequentially arranged from an upstream side of a transport direction of the sheet along a transport path of the sheet between the transfer means and the fixing means, wherein a sheet transport speed in the fixing means is set lower than a sheet transport speed in the transfer means, both an output direction of the sheet to be output from the transfer means and a tilt direction in a sheet transport direction of the first sheet transport guide are set downwardly from a horizontal direction, both an entering direction of the sheet into the fixing means and a tilt direction in a sheet transport direction of the second sheet transport guide are set upwardly from the horizontal direction, and a rear-end portion of the first sheet transport guide is positioned in substantially the center between the transfer means and the fixing means and is positioned upwardly from a front-end portion of the second sheet transport guide, forming a spacing sufficient to permit curves of the sheet to be formed.

8. The image forming apparatus according to claim 7, wherein a tilt angle in the sheet transport direction of the first sheet transport guide is set smaller than an angle of outputting the sheet that is output from the transfer means.

9. The image forming apparatus according to claim 7, wherein the transfer means comprises:

an intermediate transfer member onto which the toner image on an image bearing means is primary-transferred; and secondary transfer means for secondary-transferring the toner image on the intermediate transfer member onto the sheet, the secondary transfer means being a transfer roller that is applied with a high pressure and is in contact with the intermediate transfer member when transferring the toner image to the sheet.

10. The image forming apparatus according to any one of claims 2 and 3 to 9, wherein the first sheet transport guide comprises a plurality of ribs on a sheet transport surface, and grounded metal surfaces are exposed in regions of the transport surface other than the ribs of the first sheet transport guide.

11. The image forming apparatus according to any one of claims 2 and 3 to 9, wherein a plurality of rotational members are disposed in a downstream-side end portion of the first sheet transport guide in the sheet transport direction, the plurality of rotational members being passively rotated through transport operation of the sheet without disturbing the transport operations of the sheet.

12. An image forming apparatus comprising:

image bearing means for bearing a toner image;

transfer means for transferring the toner image on the image bearing means onto a sheet;

fixing means for fixing to the sheet the toner image transferred by the transfer means; and a first sheet transport guide and a second sheet transport guide sequentially arranged from an upstream side of a transport direction of the sheet along a transport path of the sheet between the transfer means and the fixing means, wherein a sheet transport speed in the fixing means is set lower than a sheet transport speed in the transfer means, the first sheet transport guide is disposed with a tilt with respect to a horizontal direction or a vertical direction, the second sheet transport guide is disposed with a tilt with respect to the horizontal direction or the vertical direction, a guide surface of the second sheet transport guide comprises a flat face extending in the horizontal direction or the vertical direction in the upstream side end portion and a sloped face continuing from the flat face, and a gap is provided to form spacing sufficient to permit curves of the sheet to be formed between a downstream side end portion of the first sheet transport guide and an upstream side end portion of the second sheet transport guide.

13. An image forming apparatus comprising:

image bearing means for bearing a toner image;

transfer means for transferring the toner image on the image bearing means onto a sheet;

fixing means for fixing to the sheet the toner image transferred by the transfer means; and a first sheet transport guide and a second sheet transport guide sequentially arranged from an upstream side of a transport direction of the sheet along a transport path of the sheet between the transfer means and the fixing means, wherein a sheet transport speed in the fixing means is set lower than a sheet transport speed in the transfer means, the first sheet transport guide is disposed with a tilt with respect to a horizontal direction or a vertical direction, the second sheet transport guide is disposed with a tilt with respect to the horizontal direction or the vertical direction, a tilt angle in the sheet transport direction of the first sheet transport guide is set smaller than an angle of outputting the sheet that is output from the transfer means, and a gap is provided to form a spacing sufficient to permit curves of the sheet to be formed between a downstream side end portion of the first sheet transport guide and an upstream side end portion of the second sheet transport guide.

* * * * *

UNITED STATES PATENT AND TRADEMARK OFFICE

CERTIFICATE OF CORRECTION

PATENT NO. : 7,020,431 B2
APPLICATION NO. : 10/690650
DATED : March 28, 2006
INVENTOR(S) : Hiroshi Sahara It is certified that error appears in the above-identified patent and that said Letters Patent is hereby corrected as shown below:

On Title Page col. 2 ITEM [56] RC:
Foreign Patent Documents, "JP 2002068522 a* 3/2002" should read --JP 2002-068522 a * 3/2002--.

Title Page col. 2 ITEM [57[ Abstract:
Line 3, "sheet, fixing" should read --sheet, a fixing--.

COLUMN 1:
Line 37, "th" should read --the--.

COLUMN 2:
Line 31, "sever" should read --serve--.

COLUMN 3:
Line 8, "f" should read --of--.
Line 60, "armed" should read --formed--.

COLUMN 7:
Line 60, "an" should read --a--.

COLUMN 9:
Line 14, "Transfer-m dium" should read --Transfer-medium--.
Line 20, "guide 81." should read --guide 31.--.
Line 49, "th" should read --the--.

COLUMN 11:
Line 17, "the" should read --an--.

UNITED STATES PATENT AND TRADEMARK OFFICE

CERTIFICATE OF CORRECTION

PATENT NO. : 7,020,431 B2
APPLICATION NO. : 10/690650
DATED : March 28, 2006
INVENTOR(S) : Hiroshi Sahara It is certified that error appears in the above-identified patent and that said Letters Patent is hereby corrected as shown below:

COLUMN 13:
Line 45, "claims 2 and 3 to 9," should read --claims 2 to 9,--.
Line 52, "claims 2 and 3 to 9," should read --claims 2 to 9,--.

Signed and Sealed this

Seventh Day of November, 2006

JON W. DUDAS
*Director of the United States Patent and Trademark Office*